US005388665A

United States Patent [19]

Newman

[11] Patent Number: 5,388,665

[45] Date of Patent: Feb. 14, 1995

[54] ADJUSTABLE LADDER PLATFORM

[76] Inventor: Donald W. Newman, 2405 West, 300 North, Bluffton, Ind. 46714

[21] Appl. No.: 133,887

[22] Filed: Oct. 12, 1993

[51] Int. Cl.[6] ..... E06C 1/12

[52] U.S. Cl. ..... 182/122; 182/118

[58] Field of Search ..... 182/120–122, 182/129, 118, 116; 248/140, 142

[56] References Cited

U.S. PATENT DOCUMENTS

| | | | |
|---|---|---|---|
| 62,314 | 2/1867 | Burt | 248/238 |
| 459,945 | 9/1891 | Fales | 248/142 |
| 1,253,493 | 1/1918 | James | 248/142 |
| 2,827,336 | 3/1958 | Johnson | 304/315 |
| 3,067,836 | 12/1962 | Carnicelli | 182/121 |
| 3,822,846 | 7/1974 | Jesionowski | 182/129 X |
| 4,586,586 | 5/1986 | Canals | 182/122 |
| 4,953,661 | 9/1990 | Hilton et al. | 182/120 |

*Primary Examiner*—Alvin C. Chin-Shue
*Attorney, Agent, or Firm*—Rhodes & Ascolillo

[57] ABSTRACT

An adjustable platform for attachment to a ladder, including: a frame which can be removably attached to a ladder; a planar platform fixedly mounted on a shaft rotatably disposed in the frame; and a position adjustment mechanism operatively connected to the shaft to selectively lock the platform in a desired angular position with respect to the ladder or to permit the platform and the shaft to rotate freely within the frame, the position adjustment mechanism including no threaded fasteners.

11 Claims, 4 Drawing Sheets

ADJUSTABLE LADDER PLATFORM

BACKGROUND OF THE INVENTION

1. Field of the Invention

The present invention relates to runged ladders generally and, more particularly, but not by way of limitation, to a novel positionable platform for a ladder upon which platform a user of the ladder may stand.

2. Description of the Related Art

Runged ladders have been employed for thousands of years to provide an elevated platform for various activities. A disadvantage with conventional runged ladders is that prolonged standing on a rung can be uncomfortable, at the least, and can cause foot trauma in some cases. This foot stress occurs because only a small area of the user's feet engage a rung, that area typically being under the arches of the foot. This area of the foot is not particularly strong, yet all of the user's weight is concentrated into this relatively small area. The situation is aggravated if the user is overweight. Often, the user will try to temporarily stand sideways on a rung for relief or place only the ball of his foot on a rung, but either practice is dangerous and can lead to falling off the ladder.

U.S. Pat. No. 2,827,336, issued Mar. 18, 1958, to Johnson, describes a ladder step platform which extends entirely rearwardly from a rung of a ladder. The platform extends from the rung which supports it and is relatively complex, having numerous parts that require loosening and tightening, e.g. screws and cams, for installation and adjustment.

U.S. Pat. No. 4,953,661, issued Sep. 4, 1990, to Hilton et al., describes a ladder attachment which can serve as either a tool support or a step. The attachment includes a frame and a platform hinged to the frame, the frame having brackets which are fitted over a rung that lies above the platform. The frame rests against the front face of the ladder. The angle of the platform relative to the ladder is selectively adjustable by means of saw-like racks which engage toothed brackets.

Accordingly, it is a principal object of the present invention to provide a ladder platform that is simple in construction and easily deployed.

It is a further object of the invention to provide such a ladder platform that is economically constructed.

It is an additional object of the invention to provide such a ladder platform that can be folded to a compact form, attached to the belt of the user, and easily carried up a ladder.

It is another object of the invention to provide such a ladder platform that is easily adjusted between open and closed positions.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a ladder platform, comprising: a frame which can be removably attached to a ladder; a planar platform fixedly mounted on a shaft rotatably disposed in said frame; and a position adjustment mechanism operatively connected to said shaft to selectively lock said platform in a desired angular position with respect to said ladder or to permit said platform and said shaft to rotate freely within said frame, said position adjustment mechanism including no threaded fasteners.

BRIEF DESCRIPTION OF THE DRAWINGS

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
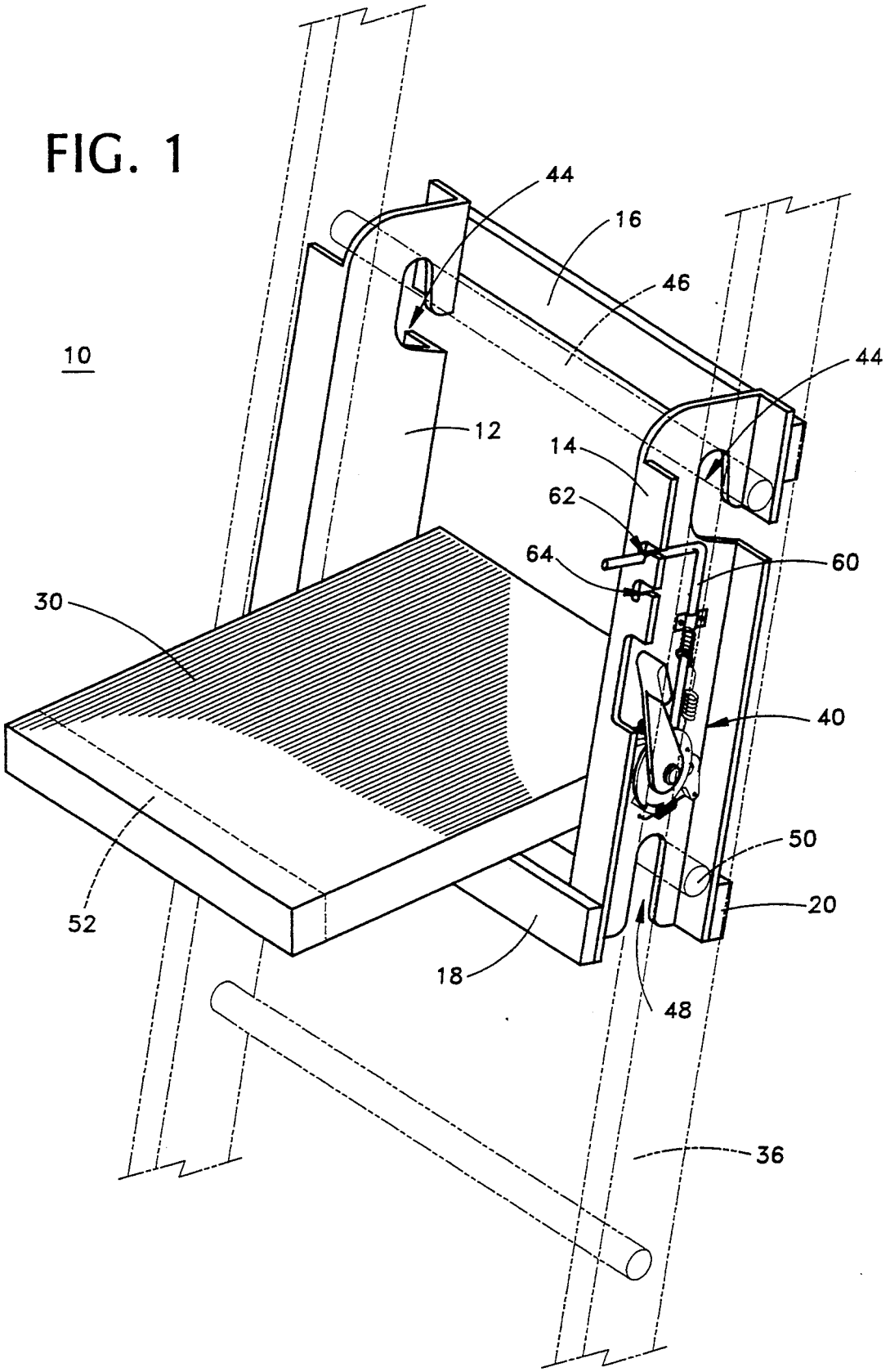
FIG. 1 is an isometric view of a ladder platform constructed according to the present invention and mounted on a ladder in an open and unlocked position.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates a ladder platform according to the present invention, generally indicated by the reference numeral 10. Ladder platform 10 includes a rectilinear frame comprising channel shaped side members 12 and 14 fixedly attached together by horizontal brackets 16, at the upper ends of the side members, and horizontal brackets 18 and 20, at the lower ends thereof. A platform 30 is rotatably disposed between side members 12 and 14, the angular position of which platform with respect to a ladder 36 on which ladder platform 10 is disposed is adjustable by an position adjusting mechanism, generally indicated by the reference numeral 40, the operation of which position adjusting mechanism will be described later.

Side members 12 and 14 each include a substantially L-shaped upper slot 44 defined in the upper rear portions thereof for fitting over a rung 46 of ladder 36. A pair of vertical lower slots 48 (only one visible on FIG. 1) is defined in the lower portions thereof for fitting over a rung 50 of ladder 36 immediately below rung 46. It will be noted that slots 48 have a greater vertical depth than slots 44. This permits lower slots 48 to be initially positioned over rung 50 and then upper slots 44 may be more easily positioned over rung 46.

A counterweight 52 may be provided at the front of platform 30 to facilitate proper setting of the position of platform 30.

No further description of the elements of ladder platform 10 will be given with reference to FIG. 1, except to note that position adjusting mechanism 40 includes a substantially L-shaped manual locking rod 60 the distal end of which is selectively insertable in either of upper or lower L-shaped slots 62 and 64, respectively, defined in side member 14. When the distal end of locking rod 60 is inserted in slot 62, the locking rod is in its unlocked position and, when the distal end of the locking rod is inserted in slot 64, the locking rod is in its locked position.

Figure 3:
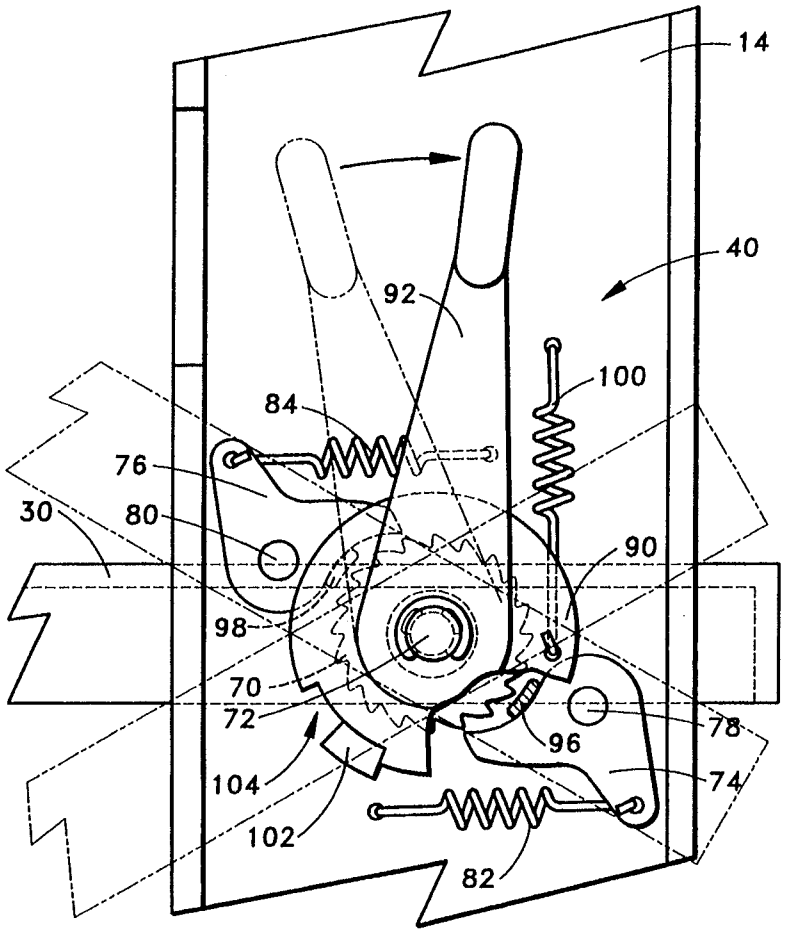
FIG. 3 is a fragmentary side elevational view of the ladder platform of FIG. 1 illustrating how the angle of the ladder platform with respect to the ladder is adjusted. The manual lock hereinafter described is not shown for purposes of clarity.
Figure 2:
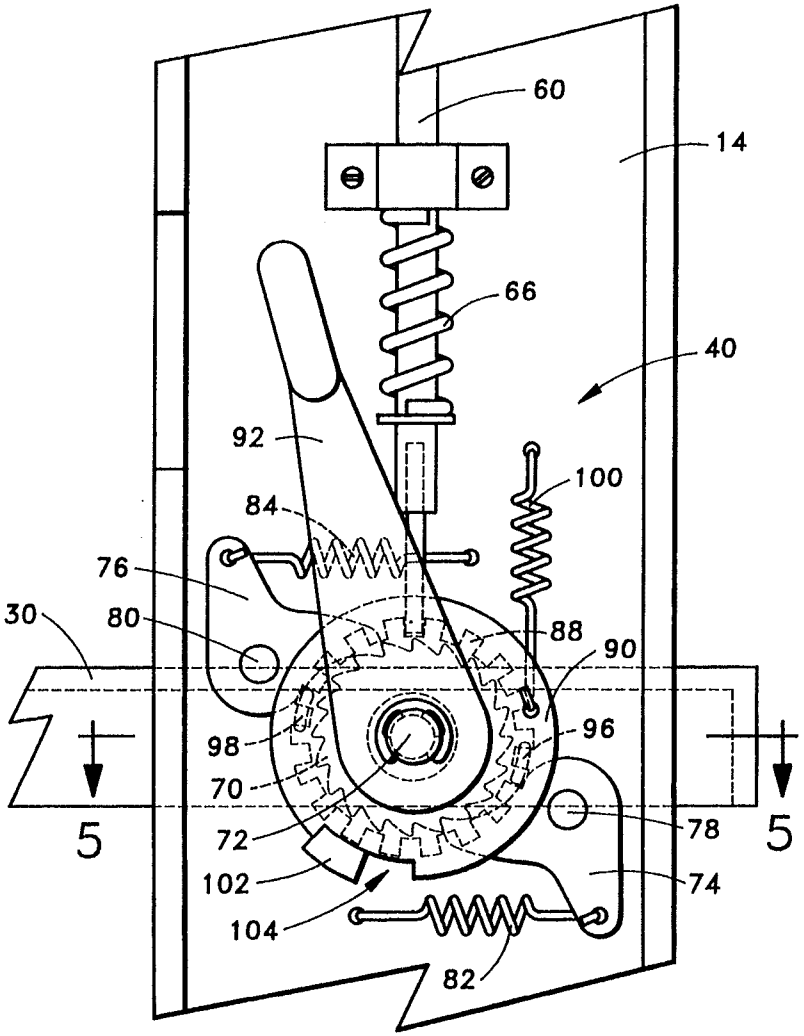
FIG. 2 is a fragmentary side elevational view of the ladder platform of FIG. 1 illustrating the platform in fixed, horizontal position.

Reference should now be made primarily to FIGS. 2 and 3 for an understanding of the operation of position adjustment mechanism 40. Mechanism 40 includes a circular ratchet wheel 70 fixedly keyed to a shaft 72 on which platform 30 is fixedly mounted. Ratchet pawls 74 and 76 rotatably mounted on shafts 78 and 80, respectively, engage ratchet wheel 70 and prevent counterclockwise rotation of platform 30 when the ratchet wheel 70 is so engaged. Ratchet pawls 74 and 76 are biased in the positions shown on FIG. 2 by means of coil springs 82 and 84, respectively, stretched between the ratchet pawls and side member 14.

Figure 4:
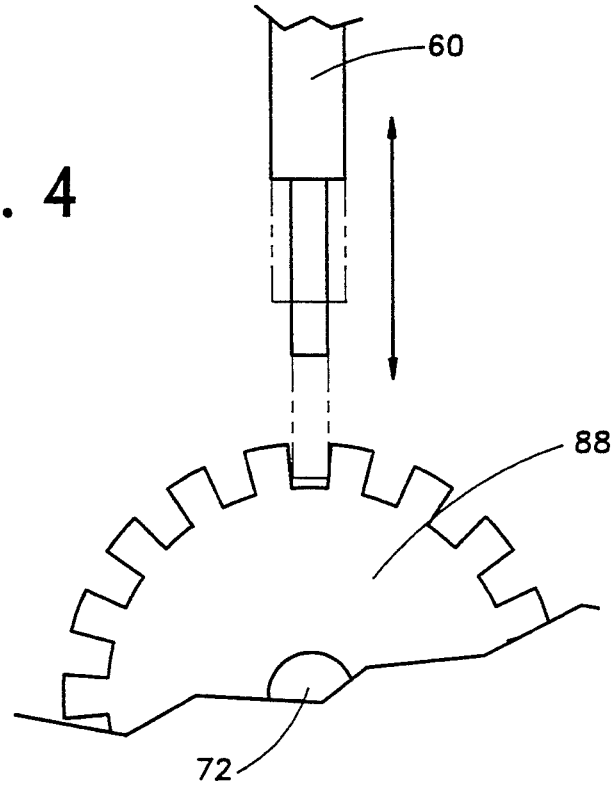
FIG. 4 is a fragmentary detail illustrating a manual lock for the present invention.
Figure 6:
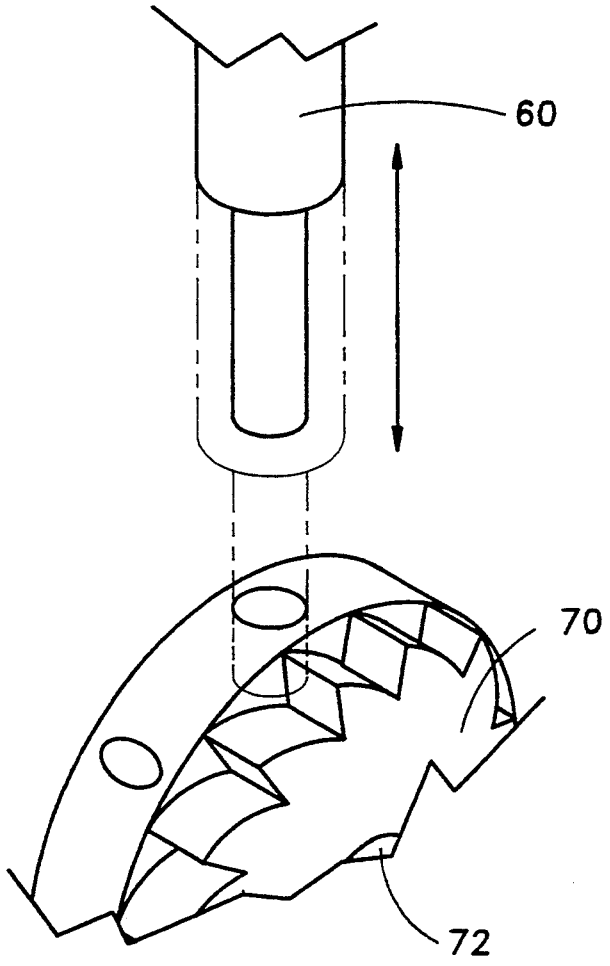
FIG. 6 is a fragmentary detail illustrating an alternate embodiment of the manual lock for the ladder platform.

Formed integrally or fixedly attached with ratchet wheel 70 is a square toothed wheel 88 between a pair of teeth of which the proximal end of manual locking rod 60 is inserted. Referring back to FIG. 1 momentarily, it will be recalled that, when locking rod 60 is in the position shown on FIG. 2, the distal end of the locking rod will be inserted into slot 64 in side member 14. Manual locking rod 60 is biased into the locking position shown on FIG. 2 by means of a coil spring 66. The action of the locking rod is also indicated by the toothed wheel 88 of FIG. 4 and by the notched wheel of the alternate embodiment shown in FIG. 6. The notched wheel is provided with at least two inwardly extending holes, and the manual locking rod 60 is selectively insertable into one of the holes.

A selective pawl releasing mechanism engages and disengages the ratchet pawls 74 and 76 in relation to the ratchet wheel 70. Rotatably mounted in the distal end of shaft 72 is a circular ratchet release plate 90 having an integral ratchet release lever 92. Integrally disposed on the inner surface of ratchet release plate 90 are two ratchet release bosses 96 and 98. A coil spring 100 stretched between ratchet release plate 90 and side member 14 biases the release plate to a counterclockwise position, the biasing being terminated by the engagement with a fixed stop 102 of an edge of a cut-out 104 defined in the periphery of the ratchet release plate 90.

When it is desired to unlock platform 30 to move the same to another angular position with respect to ladder 36 (FIG. 1), manual locking rod 60 is raised and the distal end thereof inserted into slot 62 in side member 14. Then, ratchet release lever 92 is rotated clockwise to the position shown in solid lines on FIG. 3. This causes bosses 96 and 98 to engage the inner surfaces of ratchet pawls 74 and 76, respectively, thereby lifting the ends of the pawls from ratchet wheel 70, permitting the ratchet wheel 70, shaft 72, square toothed wheel 88, and platform 30 to rotate freely either clockwise or counterclockwise, as is indicated in broken lines on FIG. 3. Clockwise rotation of ratchet release plate 90 is limited by the engagement of the other end of cut-out 104 with stop 102, as is shown on FIG. 3. When platform 30 is rotated to its desired new position, ratchet release lever 92 is released, coil spring 100 will cause ratchet release plate 90 to rotate counterclockwise, re-engaging ratchet pawls 74 and 76 with ratchet wheel 70 and preventing counterclockwise rotation of shaft 72 and platform 30. Manual locking rod 60 is then returned to its locked position (FIG. 2).

Figure 5:
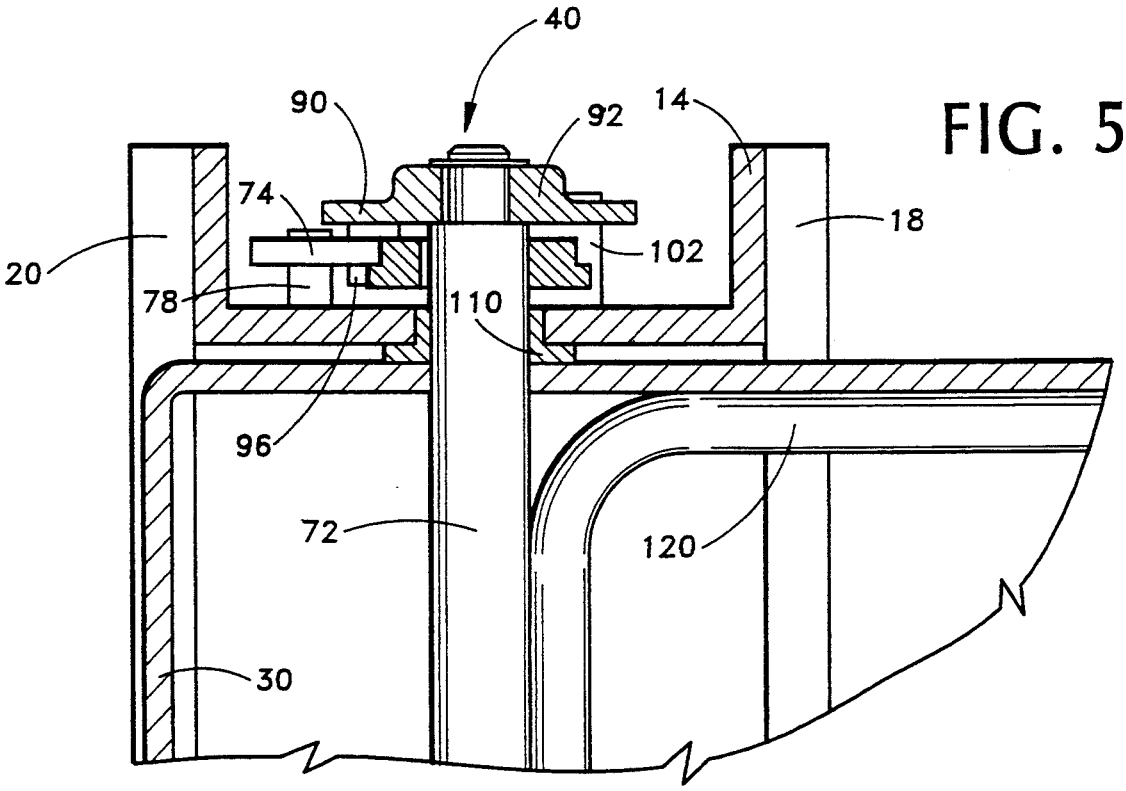
FIG. 5 is a fragmentary, bottom plan view, partially in cross-section, of the ladder platform of FIG. 1 taken along line "5—5" of FIG. 2.

Referring now to FIG. 5, it will be seen that shaft 72 is journalled in a supporting bushing 110 pressed into side member 14. It will be understood that a similar bushing is provided in side member 12 at the other end of shaft 72. Platform 30 has a tubular reinforcing member 120 fixedly attached to shaft 72 and the platform, and the tubular reinforcing member 120 encircles the inner periphery of the forward portion of the platform 30.

The elements of ladder platform 10 may be economically constructed of any suitable materials properly selected for their purposes. The upper surface of platform 30 should be covered with an abrasive material for easy gripping and safety.

In use, ladder platform 10 with platform 30 folded into the frame thereof, with manual locking rod 60 in its unlocked position (FIG. 3) is carried up ladder 36 and placed over a selected pair of rungs thereof. Then, ratchet release lever 92 is moved to its release position (FIG. 3) and platform rotated to a horizontal working position (FIG. 1). Then, ratchet release lever 92 is released to return to the position shown on figure (2) and manual locking rod is moved to its locked position (FIG. 2). Ladder platform 10 can be quickly and easily repositioned on ladder 36.

Ladder platform 10 provides a comfortable and sturdy surface on which even a fairly heavy individual can stand for long periods of time.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. An adjustable platform for attachment to a ladder, said adjustable platform comprising:

(a) a frame which can be removably attached to the ladder;

(b) a planar platform fixedly mounted on a shaft rotatably disposed in said frame, said planar platform extending substantially outwardly of the ladder; and (c) a position adjustment means operatively connected to said shaft for selectively locking said planar platform in a desired angular position with respect to the ladder or for permitting said planar platform and said shaft to rotate freely within said frame, said position adjustment means comprising:

a ratchet wheel fixedly disposed on said shaft and at least one ratchet pawl in combination therewith to prevent said planar platform from rotating outwardly when said ratchet wheel and said at least one ratchet pawl are engaged, and to permit said planar platform and shaft to rotate freely when said ratchet wheel is not so engaged;

(d) at least one L-shaped first slot defined in an upper rear portion of said frame so as to engage therein a selected first rung of the ladder;

(e) at least two upwardly extending U-shaped second slots defined in a lower portion of said frame so as to engage therein a second rung of the ladder immediately below said first rung, said second slots have a vertical depth greater than that of said at least one L-shaped first slot; and (f) means to selectively release said at least one ratchet pawl from said ratchet wheel, wherein said means comprises:

a rotatable ratchet release plate, said rotatable ratchet release plate being rotatably mounted on said shaft; and at least one boss extending from said ratchet release plate and disposed in proximity to said at least one ratchet pawl such that rotation of said ratchet release plate will cause said at least one boss to bear against said at least one ratchet pawl, thereby causing said at least one ratchet pawl to disengage said ratchet wheel;

wherein said adjustable platform is removably attached to the ladder solely by the releasable engagement of said first rung with said at least one L-shaped first slot and the releasable engagement of said second rung with said second slots.

2. An adjustable platform, as defined in claim 1, further comprising a means for selectively locking said planar platform at various positions.

3. An adjustable platform, as defined in claim 2, wherein said means for selectively locking said planar platform at various positions comprises:

(a) a toothed wheel fixedly attached to said shaft; and (b) a manual locking rod selectively insertable between a pair of teeth on said toothed wheel.

4. An adjustable platform, as defined in claim 2, wherein said means for selectively locking said planar platform at various positions comprises:

(a) a notched wheel fixedly attached to said shaft, said wheel being provided with at least two inwardly extending holes; and (b) a manual locking rod selectively insertable into one of said holes.

5. An adjustable platform for attachment to a ladder, said adjustable platform comprising:

(a) a frame which can be removably attached to the ladder;

(b) a planar platform fixedly mounted on a shaft rotatably disposed in said frame, said planar platform extending substantially outwardly of the ladder;

(c) a position adjustment means operatively connected to said shaft for selectively locking said planar platform in a desired angular position with respect to the ladder or for permitting said planar platform and said shaft to rotate freely within said frame, said position adjustment mechanism including no threaded fasteners, said position adjustment means comprising:

a ratchet wheel fixedly disposed on said shaft and at least one ratchet pawl in combination therewith to prevent said planar platform from rotating outwardly when said ratchet wheel and said at least one ratchet pawl are engaged, and to permit said planar platform and shaft to rotate freely when said ratchet wheel is not so engaged;

(d) at least one L-shaped first slot defined in an upper rear portion of said frame so as to engage therein a selected first rung of the ladder;

(e) at least two upwardly extending U-shaped second slots defined in a lower portion of said frame so as to engage therein a second rung of the ladder immediately below said first rung, said second slots have a vertical depth greater than that of said at least one L-shaped first slot; and (f) means to selectively release said at least one ratchet pawl from said ratchet wheel, wherein said means comprises:

a rotatable ratchet release plate, said rotatable ratchet release plate being rotatably mounted on said shaft; and at least one boss extending from said ratchet release plate and disposed in proximity to said at least one ratchet pawl such that rotation of said ratchet release plate will cause said at least one boss to bear against said at least one ratchet pawl, thereby causing said at least one ratchet pawl to disengage said ratchet wheel;

wherein said adjustable platform is removably attached to the ladder solely by the releasable engagement of said first rung with said at least one L-shaped first slot and the releasable engagement of said second rung with said second slots.

6. An adjustable platform, as defined in claim 5, further comprising a means for selectively locking said planar platform at various positions.

7. An adjustable platform, as defined in claim 6, wherein said means for selectively locking said planar platform at various positions comprises:

(a) a toothed wheel fixedly attached to said shaft; and (b) a manual locking rod selectively insertable between a pair of teeth on said toothed wheel.

8. An adjustable platform, as defined in claim 6 wherein said means for selectively locking said planar platform at various positions comprises:

(a) a notched wheel fixedly attached to said shaft, said wheel being provided with at least two inwardly extending holes; and (b) a manual locking rod selectively insertable into one of said holes.

9. An adjustable platform for attachment to a ladder, said adjustable platform comprising:

(a) a frame which can be removably attached to the ladder;

(b) a planar platform fixedly mounted on a shaft rotatably disposed in said frame, said planar platform extending substantially outwardly of the ladder;

(c) a position adjustment means operatively connected to said shaft for selectively locking said planar platform in a desired angular position with respect to the ladder or for permitting said planar platform and said shaft to rotate freely within said frame, said position adjustment means comprising:

a ratchet wheel fixedly disposed on said shaft and at least one ratchet pawl in combination therewith to prevent said planar platform from rotating outwardly when said ratchet wheel and said at least one ratchet pawl are engaged, and to permit said planar platform and shaft to rotate freely when said ratchet wheel is not so engaged;

(d) at least one L-shaped first slot defined in an upper rear portion of said frame so as to engage therein a selected first rung of the ladder;

(e) at least two upwardly extending U-shaped second slots defined in a lower portion of said frame so as to engage therein a second rung of the ladder immediately below said first rung, said second slots have a vertical depth greater than that of said at least one L-shaped first slot;

(f) means to selectively release said at least one ratchet pawl from said ratchet wheel;

g) a means for selectively locking said planar platform at various positions;

wherein said adjustable platform is removably attached to the ladder solely by the releasable engagement of said first rung with said at least one L-shaped first slot and the releasable engagement of said second rung with said second slots.

10. An adjustable platform, as defined in claim 9, wherein said means for selectively locking said planar platform at various positions comprises:

(a) a toothed wheel fixedly attached to said shaft; and (b) a manual locking rod selectively insertable between a pair of teeth on said toothed wheel.

11. An adjustable platform, as defined in claim 9, wherein said means for selectively locking said planar platform at various positions comprises:

(a) a notched wheel fixedly attached to said shaft, said wheel being provided with at least two inwardly extending holes; and (b) a manual locking rod selectively insertable into one of said holes.

* * * * *